US005507159A

United States Patent [19]

Cooksey

[11] Patent Number: 5,507,159

[45] Date of Patent: Apr. 16, 1996

[54] SUCTION ACCUMULATOR VIBRATION DAMPER

[75] Inventor: Edward A. Cooksey, Adrian, Mich.

[73] Assignee: Tecumseh Products Company, Tecumseh, Mich.

[21] Appl. No.: 425,332

[22] Filed: Apr. 18, 1995

Related U.S. Application Data

[63] Continuation of Ser. No. 232,988, Apr. 25, 1994, abandoned.

[51] Int. Cl.[6] ..... F25B 43/00; F04B 39/00

[52] U.S. Cl. ..... 62/503; 62/296; 417/312

[58] Field of Search ..... 62/296, 503, 512; 165/69; 417/312; 181/207, 208, 209, 403

[56] References Cited

U.S. PATENT DOCUMENTS

| | | | |
|---|---|---|---|
| 2,010,546 | 8/1935 | Kenney | 62/296 |
| 2,920,460 | 1/1960 | Atchison | 62/296 |
| 2,948,461 | 8/1960 | Frank | 230/232 |
| 3,127,157 | 3/1964 | Webb | 267/1 |
| 3,273,670 | 9/1966 | Kleinlein | 188/1 |
| 4,607,503 | 8/1986 | Fry | 62/503 |
| 4,702,346 | 10/1987 | Uno et al. | 181/207 |
| 4,827,725 | 5/1989 | Morse | 62/503 |
| 4,835,972 | 6/1989 | Tugal et al. | 62/50.1 |
| 4,962,826 | 10/1990 | House | 181/207 |
| 5,076,071 | 12/1991 | Morse | 62/503 |

FOREIGN PATENT DOCUMENTS

| | | | |
|---|---|---|---|
| 62-99680 | 5/1987 | Japan | 417/312 |
| 62-99681 | 5/1987 | Japan | 417/312 |
| 62-99682 | 5/1987 | Japan | 417/312 |
| 5-322382 | 12/1993 | Japan | 62/296 |

*Primary Examiner*—Harry B. Tanner
*Attorney, Agent, or Firm*—Baker & Daniels

[57] ABSTRACT

A suction accumulator assembly in which a flexible resiliently yieldable support is attached between the accumulator casing and an internal suction tube to allow the suction tube to move relative the accumulator casing. The flexible support includes an annular fold located circumferentially about the suction tube to increase the ability of the flexible support to damp vibration and reduce sound transmitted through the suction accumulator.

23 Claims, 3 Drawing Sheets

SUCTION ACCUMULATOR VIBRATION DAMPER

This is a continuation of application Ser. No. 08/232,988, filed Apr. 25, 1994, abandoned.

BACKGROUND OF THE INVENTION

The present invention relates to refrigerant compressors, and more particularly to associated suction accumulators.

Suction accumulators are well known in the refrigeration art and are provided in refrigeration systems to prevent liquid refrigerant from entering the compressor cylinder and thereby cause slugging within the compressor. This slugging condition may occur at startup of the refrigeration system or during certain operating conditions of the system wherein the evaporator is flooded and excess liquid refrigerant enters the suction line to the compressor. Such accumulators act as storage reservoirs for liquid refrigerant.

If the compressor is operated with a large quantity of liquid present therein, abnormally high pressure results which frequently causes blown gaskets or damaged valves. Suction accumulators are constructed to cause the stored liquid refrigerant to flash off into a gaseous state prior to entering the compressor suction tube and the compressor cylinder, thus reducing the internal pressure.

Prior art suction accumulators, such as the one shown in U.S. Pat. No. 4,827,725, having internal tubing fixedly attached to both endwalls, have a disadvantage in that the tubing tends to transmit compressor vibrations through the accumulator housing instead of damping them.

Additionally, it has been found that previous suction accumulators have had an endwall thickness that was relatively thin in order to use a minimum of materials. The problem with this construction is that noise generated by the operation of the compressor tends to be amplified by this bottom portion of the accumulator, which acts similarly to a drum skin, that resonates at the noise pulse frequency of the compressor.

It is therefore desired to provide an accumulator which attenuates rather than amplifies the noise generated by the compressor.

SUMMARY OF THE INVENTION

The present invention overcomes the disadvantages of the above described prior art accumulators connected to compressor assemblies by providing an improved accumulator therefore.

The accumulator of the present invention includes a cylindrical housing having two endwalls. One of the endwalls includes an aperture with a suction conduit tube passing therethrough. The suction conduit is in communication with the inlet to a compressor. A flexible resilient yieldable support is attached to the accumulator housing and the suction conduit. The flexible support permits the suction conduit to move, slightly, relative the housing, thereby reducing the sound transmitted through the suction tube to the housing.

In one form of the invention, the flexible support includes an annular fold encircling the suction conduit to damp axial movement of the conduit and increase control of movements in other directions. This slight resilient movement of the flexible support and conduit allows for greater vibration damping than in prior art suction accumulators.

An advantage of the accumulator according to the present invention is that the noise pulses generated by the compressor are attenuated by the flexible support absorbing movement of the suction conduit.

Another advantage of the accumulator according to the present invention is a biased connection between the flexible support and suction tube created by a bending of inwardly extending attachment tabs on the support member. These tabs create an interference fit with the suction tube and assist in maintaining the tube in a central location within the accumulator.

The present invention, in one form thereof, comprises a suction accumulator having a storage vessel for defining a storage volume, the vessel having and inlet and an outlet. A suction tube is disposed in the vessel with one end of the tube connected to the outlet while the other end with a gas inlet opening is disposed within the storage volume. A flexible resiliently yieldable support connects the tube to the vessel permitting relative movement therebetween to isolate sound and reduce vibration between said tube and said vessel. The flexible support includes an annular fold that encircles the suction tube to further damp movement of the tube.

The present invention, in another form thereof, includes a storage vessel including a housing or casing having an endwall defining a storage volume. A suction tube is disposed in the vessel with one end attached to the vessel and the other end centrally located therein. A flexible resiliently yieldable support is attached to said vessel between the vessel and tube permitting the tube to move axially relative the vessel. The flexible support also includes a plurality of tabs oriented radially inward that engage about the tube to damp tube movement.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrates two preferred embodiments of the invention, and such exemplifications are not to be construed as limiting the scope of the invention in any manner.

DETAILED DESCRIPTION OF THE INVENTION

Figure 1:
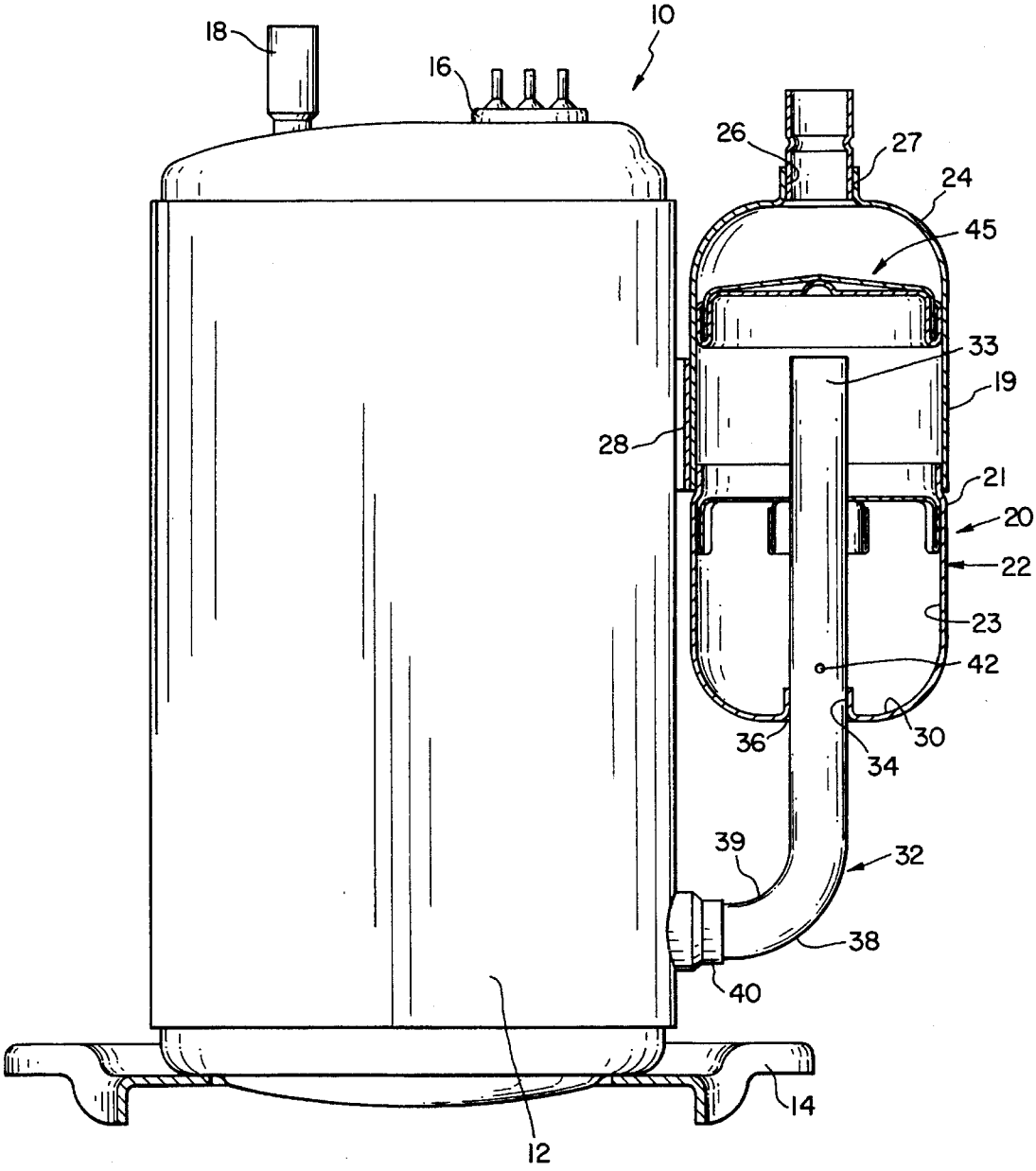
FIG. 1 is an elevational view, partly in cross section, of a compressor assembly including the suction accumulator of the present invention.

Referring to FIG. 1, a compressor 10 is shown including a compressor casing or housing 12 with compressor mounting brackets 14 attached thereto. The compressor housing or shell is also provided with an electrical terminal 16 for connection to a source of electrical energy. Discharge outlet 18 is provided for connection of compressor 10 to a condenser (not shown) of a typical refrigeration system in a conventional manner.

Figure 2:
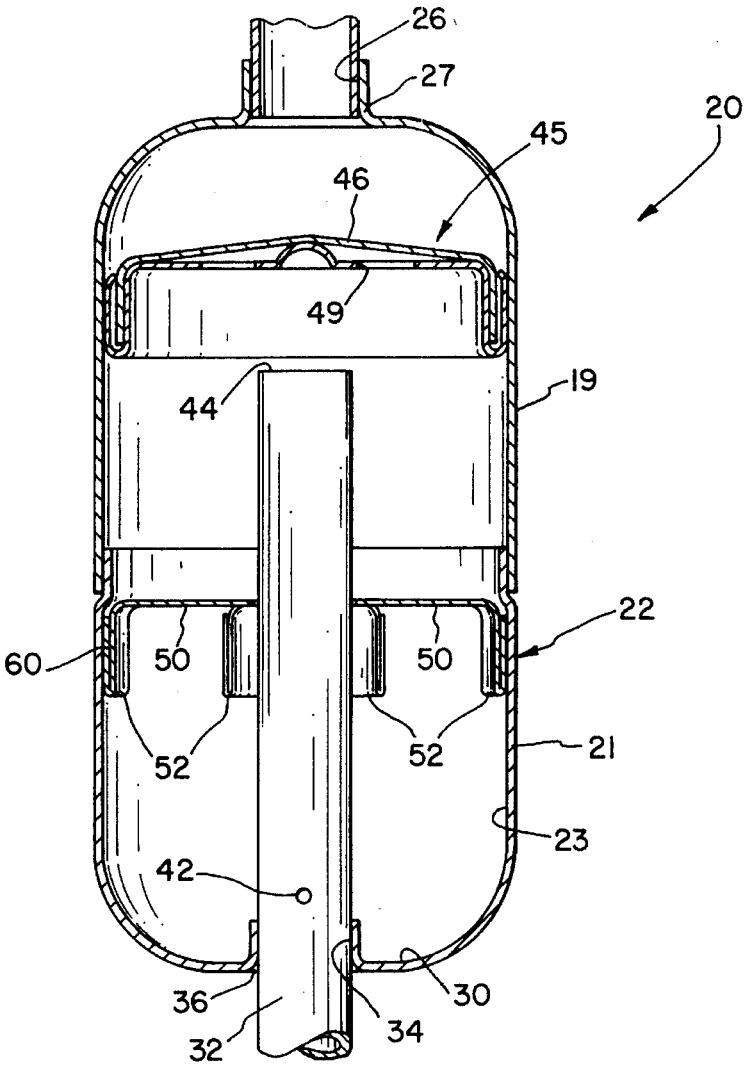
FIG. 2 is an enlarged sectional view of the suction accumulator of the present invention.

Suction accumulator 20, including a storage vessel such as accumulator casing 22, preferably cylindrical in shape, is shown in FIG. 2. Casing 22 may be formed in one or more portions but preferably as two portions 19 and 21 as shown, to permit interior access prior to being soldered together. Casing 22 has an interior surface 23.

Accumulator 20 includes a curved endwall 24 having a tubular portion 27 and an inlet aperture 26. An endwall 30, opposite to endwall 24, is curved and may be formed integrally with cylindrical accumulator casing 22. The stiff, relatively inflexible bottom endwall 30 should have a relatively high, natural resonance frequency whereby the low frequency components of the noise generated by the compressor will be diminished. Since low frequencies are especially objectionable, the apparent noise generated by the compressor will appear to be attenuated.

Accumulator casing 22 is secured to the compressor housing 12 by means of a mounting bracket 28. Preferably the spacing between accumulator casing 22 and compressor casing 12 is as small as possible for optimum compactness of the assembly. Accumulator casing 22 may be manufactured from any suitable material, such as aluminum, steel, or copper for corrosion resistance and to facilitate connection of the accumulator to the lines of the refrigeration system by soldering, brazing or the like.

First end portion 33 of suction conduit or tube 32 is shown in FIGS. 1 and 2, extending into accumulator 20 through aperture 34 in endwall 30. It should be noted that this aperture 34 is located near the center of endwall 30, preferably but not necessarily symmetrical with respect to the center of endwall 30. Suction tube 32 is secured to endwall 30 by means of soldering, brazing, or the like as at 36, and forms a sealed connection thereby preventing escape of gas or liquid from accumulator 22. The first end portion 33 of suction tube 32 extends into accumulator 20 so that suction tube inlet 44 is centrally located in casing 22.

Suction tube 32, as shown in FIG. 1, also includes a bend or elbow portion 38 creating an end portion 39 of suction tube 32 to extend at a substantially right angle to portion 33. End portion 39 may be connected to compressor housing 12 by a suction inlet adapter 40. The radius of elbow 38 of tube 32 is limited by the size of the tube diameter. If too small a radius is chosen, the tube will flatten and be pinched shut and restrict the flow of refrigerant thereby causing an undesirable pressure drop. The diameter of tube 32 can therefore be maximized for the particular diameter and geometry of accumulator casing 22. This is of great advantage since a large diameter for tube 32 minimizes the pressure drop through tube 32 and thereby maximizes the efficiency of the refrigeration system.

The present invention, in one form, includes a flexible, resiliently yieldable support 50 attached between the inside surface 23 of accumulator casing 22 and the outside diameter of the first end portion 33 of suction tube 32. Flexible support 50 acts as a damper to permit suction tube 32 to move slightly radially relative the casing 22 and thereby reduce sound transmitted from compressor 10 to casing 22.

Figure 4:
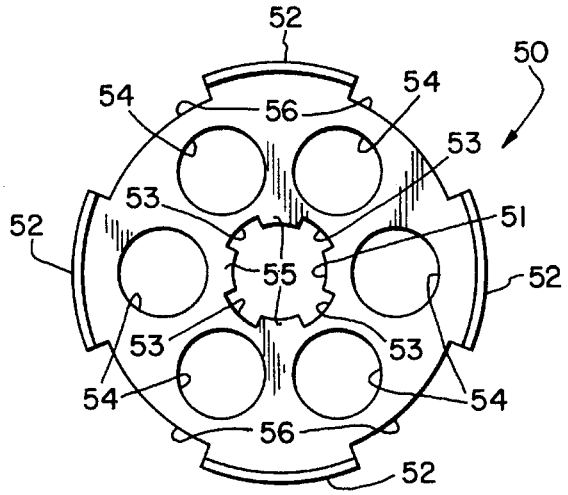
FIG. 4 is a top plan view of the flexible support of FIG. 3.
Figure 5:
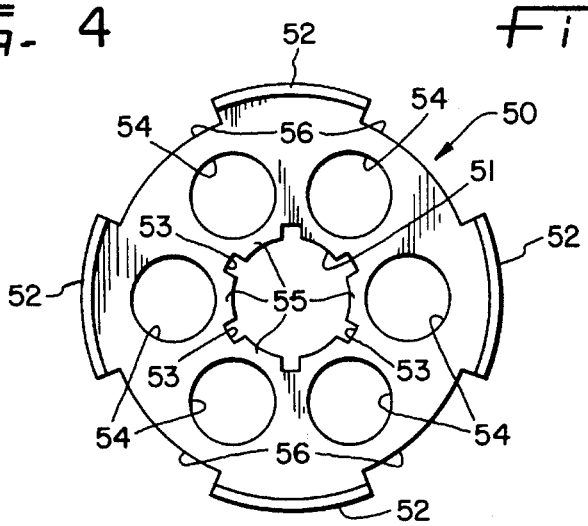
FIG. 5 is a top plan view of an alternative embodiment of the flexible support.

FIGS. 4 and 5 show flexible support 50 including a centrally located opening 51 through which suction tube 32 interfits and attaches by an interference fit or alternatively by brazing. Support 50 further includes a plurality of inner radial notches 53 about opening 51 that act to reduce the force necessary to insert tube 50 while further reducing the mass of support 50. These inner radial notches 53 form tabs 55 therebetween to which suction tube 32 is attached by means such as brazing. Notches 53 and tabs 55 additionally create a slight spring force, when tube 32 is inserted, to hold suction tube 32 by an interference fit, thereby allowing for tolerances in suction tube diameter.

Figure 7:
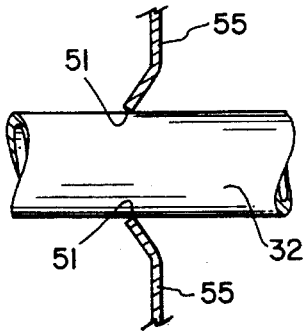
FIG. 7 is an enlarged exaggerated sectional view of the attachment of the flexible support to suction tube.

FIG. 7 illustrates the concept of the creation of the spring force by tabs 55. Tube 32, when inserted into opening 51 within support 50, causes tabs 55 to deflect in the direction of tube insertion. This deflection of the plurality of tabs 55 causes tube 32 to be constantly biased radially inward by support 50, further reducing tube 32 vibration.

By virtue of the spring force of tabs 55, attached about the sides of tube 32, tube 32 is urged to maintain in a central location of casing 22. Additionally, circumferential radial notches 56 about the perimeter of flexible support 50 prevent refrigerant or lubrication oil from being trapped on one side of support 50.

Figure 3:
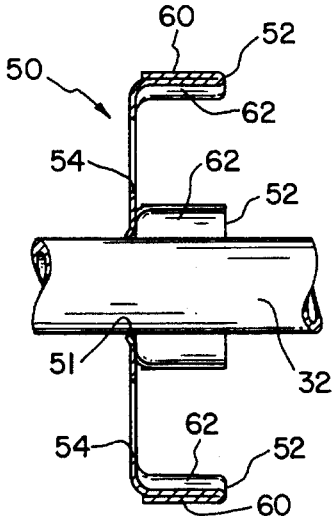
FIG. 3 is a sectional view of an embodiment of the flexible support of the suction accumulator of the present invention.

As shown in FIGS. 3 and 5, flexible support 50 includes an annular fold 52 about suction tube 32. This fold 52 further reduces the amount of sound transmitted to the casing 22 by acting as a sound damper in conjunction with the resilient yieldable characteristic of the material of support 50. Vibration of suction tube 32 will tend to temporarily deform support 50 at fold 52 rather than be transmitted to casing 22. Fold 52 creates a location where portions of support 50 will move or slide and vibrate, with a corresponding reduction of transmission of vibration to casing 20.

Figure 8:
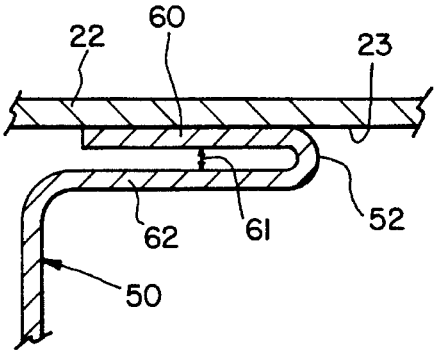
FIG. 8 is an enlarged exaggerated sectional view of the attachment of the flexible support to the housing.

Specifically, movement of suction tube 32 will be reduced and damped by support 50 by the support resiliently slightly bending in response to the movement or vibration of tube 32. Additionally, support 50 may be corrugated thereby having a plurality of folds 52. Each fold 52, in the embodiment shown in FIG. 8, is located between a radially outer portion 60 and a radially inner portion 62 of support 50. Portion 60 is attached, as by brazing, to interior surface 23 of casing 22. Although fold 52 is shown in FIG. 8 as a complete fold allowing a 180° change of direction of support 50 from outer portion 60 to inner portion 62, other degrees or shapes of folding may be used depending on the material and amount of damping needed.

Support 50 includes a plurality of openings 54 that permit liquid and gaseous refrigerant to flow through the accumulator.

Flexible support 50 may be manufactured of any suitable material such as steel, aluminum, or any other particular material which exhibits the flexibility and damping characteristics necessary for optimum reduction in sound transmission. Preferably, support 50 is constructed from cold rolled steel approximately 0.018 inches to 0.024 inches thick.

In one preferred embodiment, the spacing 61 between radially outer portion 60 and radially inner portion 62 is approximately the thickness of support 50, although other size gaps may be utilized.

Tube 32 is also provided with a small aperture 42 for aspirating a small amount of liquid refrigerant into suction tube 32 depending on the orientation of the compressor. The size of aperture 42 is approximately 0.038 inches to 0.042 inches in diameter. Upon aspiration, any liquid refrigerant suctioned into tube 32 flashes into its gaseous state.

Figure 6:
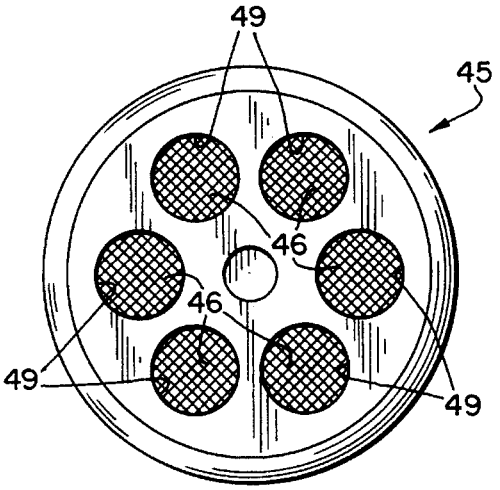
FIG. 6 is a sectional view of the suction accumulator baffle of FIG. 1.

As shown in FIGS. 2 and 6, accumulator 20 also includes a screen baffle assembly 45 having a screen 46 attached by a screen support 48 whereby any impurities in the entering refrigerant will be filtered out by screen 46 prior to the entry of refrigerant into tube 32. Screen support 48 includes a plurality of openings 49 through which filtered refrigerant passes.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A suction accumulator for a compressor of a refrigeration system, comprising:

a storage vessel defining an interior storage volume, said vessel having a first end including an inlet and a second end including an outlet;

a tube disposed within said vessel, said tube having one end connected to said vessel outlet and another end having a gas inlet opening disposed within said volume; and a flexible resiliently yieldable support connecting said tube to said vessel permitting relative movement therebetween, said support including a plurality of spring tabs that engage about said tube, whereby sound traveling through said tube is substantially isolated from said vessel.

2. The suction accumulator of claim 1 in which said flexible support includes a fold to dampen movement of said tube relative to said housing.

3. The suction accumulator of claim 1 in which said flexible support includes a fold that bends back on itself to dampen movement of said tube relative to said housing.

4. The suction accumulator of claim 2 in which said fold encircles said tube.

5. The suction accumulator of claim 1 in which said flexible support includes a plurality of openings that permit refrigerant to flow past said flexible support to prevent refrigerant accumulation behind said flexible support.

6. The suction accumulator of claim 1 in which said flexible support includes a central opening into which said tube interfits, said support including a plurality of tabs adjacent said opening and directed inward, said tabs biasing said tube radially inwardly and connecting said flexible support to said tube.

7. The suction accumulator of claim 6 in combination with a compressor for compressing refrigerant fluid.

8. The suction accumulator of claim 1 in combination with a compressor for compressing refrigerant fluid.

9. The suction accumulator of claim 1 in which said tube is axially oriented within said tube and said flexible mounting permits radial movement of said tube relative said vessel.

10. The suction accumulator of claim 1 in which said flexible support includes a fold at an angle to said flexible support that permits said flexible support to resiliently support and dampen movement of said tube.

11. A suction accumulator, comprising:

a storage vessel including a casing having a first endwall and defining a storage volume;

a tube disposed in said vessel, said tube having one end attached to said vessel and another end centrally located within said vessel; and a flexible support attached to said vessel between said vessel and said tube permitting said tube to move axially relative said support, said support including a plurality of spring tabs oriented radially inward that engage about said tube to damp movement of said tube.

12. The suction accumulator of claim 11 in which said flexible support includes a plurality of openings that permit refrigerant to flow past said flexible support to prevent refrigerant accumulation behind said flexible support.

13. The suction accumulator of claim 11 in which said flexible support includes a circumferential fold to dampen movement of said tube.

14. The suction accumulator of claim 11 in which said flexible support includes a fold that bends back on it self to dampen movement of said tube.

15. The suction accumulator of claim 11 in which said flexible support includes a plurality of circumferential notches that permit refrigerant to flow past said flexible support to prevent refrigerant accumulation behind said flexible support.

16. The suction accumulator of claim 11 in which said fold encircles said tube.

17. The suction accumulator of claim 15 in combination with a compressor for compressing refrigerant fluid.

18. The suction accumulator of claim 11 in combination with a compressor for compressing refrigerant fluid.

19. The suction accumulator of claim 11 in which said tube is axially oriented within said tube and said flexible mounting permits radial movement of said tube relative said vessel.

20. A suction accumulator for a compressor of a refrigeration system, comprising:

a storage vessel defining an interior storage volume, said vessel having a first end including an inlet and a second end a tube axially disposed within said vessel, said tube having one end connected to said vessel outlet and another end having a gas inlet opening disposed within said volume; and a flexible resiliently yieldable support connecting said tube to said vessel permitting relative radial movement therebetween, said support including a spring tab means for engaging said tube, whereby vibration traveling through said tube is substantially isolated from said vessel.

21. A suction accumulator for a compressor of a refrigeration system, comprising:

a storage vessel defining an interior storage volume, said vessel having a first end including an inlet and a second end including an outlet;

a tube disposed within said vessel, said tube having one end connected to said vessel outlet and another end having a gas inlet opening disposed within said volume; and a flexible, resiliently yieldable support connecting said tube to said vessel permitting relative movement therebetween whereby sound travelling through said tube is isolated from said vessel, said flexible support including a fold that bends back on itself to dampen movement of said tube relative to said housing, said fold extending in the axial direction to thereby permit radial motion of said tube relative to said vessel.

22. The suction accumulator of claim 21 wherein said fold encircles said tube.

23. The suction accumulator of claim 21 wherein said flexible support includes a plurality of openings that permits refrigerant to flow passed said flexible support to prevent refrigerant accumulation behind said flexible support.

* * * * *

UNITED STATES PATENT AND TRADEMARK OFFICE

CERTIFICATE OF CORRECTION

PATENT NO. : 5,507,159

DATED : April 16, 1996

INVENTOR(S) : EDWARD A. COOKSEY

It is certified that error appears in the above-indentified patent and that said Letters Patent is hereby corrected as shown below:

Claim 20, column 6, line 37, after "end" insert --including an outlet--.

Signed and Sealed this

Ninth Day of July, 1996

*Attest:*

*Attesting Officer*

BRUCE LEHMAN

*Commissioner of Patents and Trademarks*